US005611391A

United States Patent [19]

Hyp

[11] Patent Number: 5,611,391

[45] Date of Patent: Mar. 18, 1997

[54] POWERED GUIDE TUBES

[75] Inventor: Edward J. Hyp, Irwin, Pa.

[73] Assignee: Westinghouse Electric Corporation, Pittsburgh, Pa.

[21] Appl. No.: 286,489

[22] Filed: Aug. 4, 1994

[51] Int. Cl.[6] ..... F28F 27/00

[52] U.S. Cl. ..... 165/11.2; 165/11.1; 376/249

[58] Field of Search ..... 165/11.2, 11.1, 165/95; 376/248, 249, 405

[56] References Cited

U.S. PATENT DOCUMENTS

| | | | |
|---|---|---|---|
| H1,115 | 12/1992 | Nachbar | 165/11.1 |
| 4,326,317 | 4/1982 | Smith et al. | 15/315 X |
| 4,515,747 | 5/1985 | Creek et al. | 376/249 |
| 4,575,185 | 3/1986 | Wentzell et al. | 350/96.26 |
| 4,638,667 | 1/1987 | Zimmer et al. | 73/432.1 |
| 4,661,309 | 4/1987 | Hayes | 376/248 |
| 4,702,878 | 10/1987 | Klug et al. | 376/249 |
| 4,725,398 | 2/1988 | Ruckey et al. | 376/249 X |
| 4,760,876 | 8/1988 | Minogue | 165/11.2 |
| 4,848,278 | 7/1989 | Theiss | 122/383 |
| 4,971,140 | 11/1990 | Stoss | 165/95 |
| 5,036,871 | 8/1991 | Ruggieri et al. | 134/167 |
| 5,065,703 | 11/1991 | Lee | 122/382 |
| 5,069,172 | 12/1991 | Shirey et al. | 122/382 |
| 5,088,451 | 2/1992 | Hu et al. | 122/388 |
| 5,105,876 | 4/1992 | Burack et al. | 165/11.2 |
| 5,164,151 | 11/1992 | Shah | 165/11.2 X |
| 5,194,217 | 3/1993 | St. Louis et al. | 376/316 |
| 5,201,281 | 4/1993 | Cella | 122/382 |
| 5,265,129 | 11/1993 | Brooks et al. | 376/248 |
| 5,341,406 | 8/1994 | Jens et al. | 165/95 X |

*Primary Examiner*—John Rivell
*Assistant Examiner*—Christopher Atkinson

[57] ABSTRACT

An apparatus for positioning a search device and a retrieval device in a steam generator includes a guide mechanism for guiding the devices through the annulus to the tube sheet and drive mechanisms for driving the cables of the devices. Alternatively, a plurality of guide mechanisms and a plurality of drive mechanisms may be provided for a plurality of search and retrieval devices. The guide mechanism may include two double-dog-leg, single-piece, guide tubes between the handhole and the tube sheet for guiding the cables. The drive mechanisms may each include a pair of pinch rollers for driving a corresponding cable, a remote energizing mechanism for independently energizing the corresponding drive mechanism, and a reversible motor having a drive shaft. One pinch roller is driven by one drive shaft and the other pinch roller freely rotates about the other drive shaft. The guide mechanism may also include a guide plate mounted to the handhole and dual sets of guide tubes for the two halves of the tube sheet. The apparatus may further include a selection mechanism for selecting either half of the tube sheet for positioning the devices thereon. The selection mechanism may include a moving mechanism for moving the drive mechanisms between the halves of the guide plate. The moving mechanism may include a handle mechanism for rotating the drive mechanisms between the halves. A pivot mechanism may be fixedly attached to a holding mechanism, which holds the plurality of drive mechanisms, in order to pivot the holding mechanism about the guide plate.

16 Claims, 10 Drawing Sheets

POWERED GUIDE TUBES

BACKGROUND OF THE INVENTION

1. Field of the Invention

This invention relates to search and retrieval of foreign objects from a heat exchanger and more particularly to independently positioning multiple search and retrieval devices within a nuclear steam generator.

2. Background of Information

In a pressurized water nuclear powered electric generating system, the heat generated by a nuclear reactor is absorbed by a primary coolant that circulates through the reactor core and is utilized to generate steam in a steam generator. The steam generator typically is an upright cylindrical pressure vessel with hemispherical end sections. Such a generator typically comprises an outer vertically oriented shell, a horizontal plate called a tube sheet adjacent to the lower end of the shell, a bundle of vertical U-shaped tubes supported by the tube sheet, and a wrapper barrel inside of the outer shell surrounding the tubes and extending from the upper portion of the shell downwardly to a predetermined point above the tube sheet. The wrapper barrel forms a narrow annulus inside the shell and generally extends down to a point approximately twelve to fourteen inches above the tube sheet. The outer cylindrical shell is provided with one or more openings of limited size called handholes which are typically located about five to twenty-one inches above the tube sheet. These handhole openings are covered during operation of the steam generator but may be opened when the generator is shut down to permit access to the area inside for maintenance purposes.

Occasionally, during maintenance inside the steam generator, objects such as bolts, wires or other foreign objects are inadvertently introduced into the system and have to be removed. Due to the limited space within the generator, the annulus between the wrapper barrel and the shell generally is only about 1.5 to 2.75 inches wide, the space between the shell and the tubes is typically only about 4.5 inches wide, and the space between the bottom of the wrapper barrel and the tube sheet is usually only about twelve to fourteen inches high. The bundle of tubes supported by the tube sheet also are very closely spaced together. Therefore, it is difficult to insert a device into the steam generator annulus. Furthermore, it is difficult to pick up objects between the tubes on the tube sheet.

U.S. Pat. No. 4,638,667 discloses a probe positioning apparatus which includes an elongated extensible boom and an elongated flexible probe carrier tape. The boom has an end which is adapted for extension into and retraction from the tube lane of a steam generator. The carrier tape has sprocket holes for transporting the probe. The end of the boom, which is located within the steam generator, has a tractor feed unit and two sprocket belts for feeding the carrier tape. A drive motor rotates the tractor feed unit 180° in order to investigate tube rows on both sides of the tube lane. Located outside of the steam generator is a tape withdrawing assembly which includes a drive motor and a sprocket for retrieving the carrier tape.

U.S. Pat. No. 4,760,876 discloses a transport system for an inspection system having an end effector which carries inspection and gripping devices, a hollow flexible conduit which passes control cables for the end effector therethrough, and a drive assembly which moves the flexible conduit in axial and rotational directions.

U.S. Pat. No. 4,702,878 discloses a device for searching and retrieving foreign objects on the tube sheet of a steam generator. The device includes a probe for searching for foreign objects on the surface of the tube sheet and a gripper for grasping one of the foreign objects. The device is inserted into the annulus using a guide tube having a straight main segment, an L-shaped upper segment which is bent at a right angle with respect to the main segment, and an L-shaped lower segment. The lower segment, which rests on the surface of the tube sheet, is bent at a right angle with respect to the main segment and extends in a direction rotated 90° from the direction of the upper segment. The upper segment is secured to the handhole by a guide plate. To facilitate insertion of the guide tube into the steam generator, the upper, main and lower segments are constructed from separate parts.

U.S. Statutory Invention Registration No. H1115 discloses a robot arm apparatus having two or more cascaded conduit elements and a flexible movable conduit. The flexible conduit passes through the cascaded conduit elements and conveys inspection and/or maintenance apparatus to the interior of a steam generator. The flexible conduit has a terminal working end which is translated into and around the interior of the steam generator. A first reversible motor translates the cascaded conduit elements in a first axis within the tube lane. A second reversible motor translates the flexible conduit in a direction perpendicular to the first axis. A third reversible motor rotates a carriage which carries the cascaded conduit elements and, thus, moves the terminal working end in a third direction of travel, which is a curved path.

It is known to manually utilize a pair of parallel guide tubes between one handhole and the tube lane in order to manually and independently position, through each of the parallel guide tubes, a search probe and a retrieval device. Each guide tube is formed from a plurality of swage-locked conduits and is taped to a corresponding guide tube of the pair. Such parallel guide tubes have an L-bend in order to manually and independently position, through each of the parallel guide tubes, a search probe and a retrieval device in an axis perpendicular to the tube lane. It is also known to manually utilize two guide tubes between one handhole and the annulus. Each guide tube is a flexible conduit and is independent from the other of the two guide tubes. These two guide tubes are used to manually and independently position a search probe and a retrieval device on the tube sheet within the annulus.

In these manners, for example, the search probe may be used to view a foreign object lodged within the steam generator from a variety of angles while the retrieval device has grasped, but not yet retrieved, the object. Also, because of such independent operation, the search probe may be used to search for a second foreign object while the retrieval device retrieves the first foreign object. However, during such manual positioning, inspection personnel for nuclear steam generators are exposed to increased levels of radiation during manual search and retrieval at the handhole.

There is a need, therefore, for an apparatus for searching and retrieving foreign objects from a steam generator which permits inspection personnel to remotely and independently position inspection probes and retrieval devices within a steam generator.

There is a more particular need for such an apparatus which permits inspection personnel to remotely and independently position such probes and devices within the annulus of the steam generator.

There is an even more particular need for such an apparatus which permits inspection personnel to remotely, independently and selectively position such probes and devices within a selected half of the annulus.

SUMMARY OF THE INVENTION

These and other needs are satisfied by the invention which is directed to an apparatus for use with the cables of search and retrieval devices for positioning such devices within a steam generator. The apparatus includes a guide mechanism for guiding the devices from the handhole and through the annulus of the steam generator. The apparatus also includes a first drive mechanism for driving the cable of the search device and a second drive mechanism for driving the cable of the retrieval device, in order to position the search device and the retrieval device within the steam generator. Alternatively, a plurality of guide mechanisms and a plurality of drive mechanisms may be provided for a plurality of search and retrieval devices.

The guide mechanism may include two guide tubes between the handhole and the tube sheet of the steam generator. Each of the guide tubes may guide the cable of a corresponding search device or retrieval device. The guide tubes may have a double-dog-leg shape, a single-piece construction, and may be manually inserted into the steam generator without breaking the plane of the handhole and without human entry into the steam generator.

The drive mechanisms may each include a pair of pinch rollers for driving the cable of a corresponding search device or retrieval device. Each of the drive mechanisms may also include a reversible motor having a drive shaft for driving the pair of pinch rollers and a remote energizing mechanism for independently energizing a corresponding drive mechanism. Each of the reversible motors may be independently energized by a corresponding remote energizing mechanism, in order to independently drive the corresponding drive shaft and pair of pinch rollers. For each of the drive mechanisms, one of the pinch rollers may be driven by the drive shaft of one reversible motor and the other pinch roller may freely rotate about the drive shaft of the other reversible motor.

The guide mechanism may also include a guide plate which is mounted to the handhole, two guide tubes between the handhole and one half of the tube sheet, and two guide tubes between the handhole and the other half of the tube sheet. Each pair of guide tubes terminates on one half of the guide plate and interconnects the handhole with a corresponding half of the tube sheet. Both pairs of pinch rollers may be located at the same half of the guide plate. Alternatively, one pair of pinch rollers may be located at a position which corresponds to one half of the guide plate and the other pair of pinch rollers may be located at a position which corresponds to the other half of the guide plate.

The apparatus may further include a selection mechanism which cooperates with the drive mechanisms for selecting either half of the tube sheet for positioning the search and retrieval devices thereon. The selection mechanism may include a moving mechanism for moving the drive mechanisms between the halves of the guide plate. The selection mechanism may further include a pivot mechanism which is fixedly attached to a holding mechanism for holding the plurality of drive mechanisms. The guide plate may include a perpendicular rod which is attached between the halves of the guide plate. The moving mechanism may include a handle mechanism for rotating the drive mechanisms between such halves. The pivot mechanism may pivot the holding mechanism about the perpendicular rod.

The selection mechanism may selectively locate the drive mechanisms between two locations on the guide plate which correspond to the plurality of guide tubes at the two halves of the tube sheet. The moving mechanism may also include two latches for latching the holding mechanism at the two locations. Each of the plurality of guide tubes may have an opening at the guide plate. Each of the pairs of pinch rollers may engage the cable of one of the plurality of search and retrieval devices at about the opening of a corresponding one of the plurality of guide tubes at one half of the guide plate when the holding mechanism is rotated thereto.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
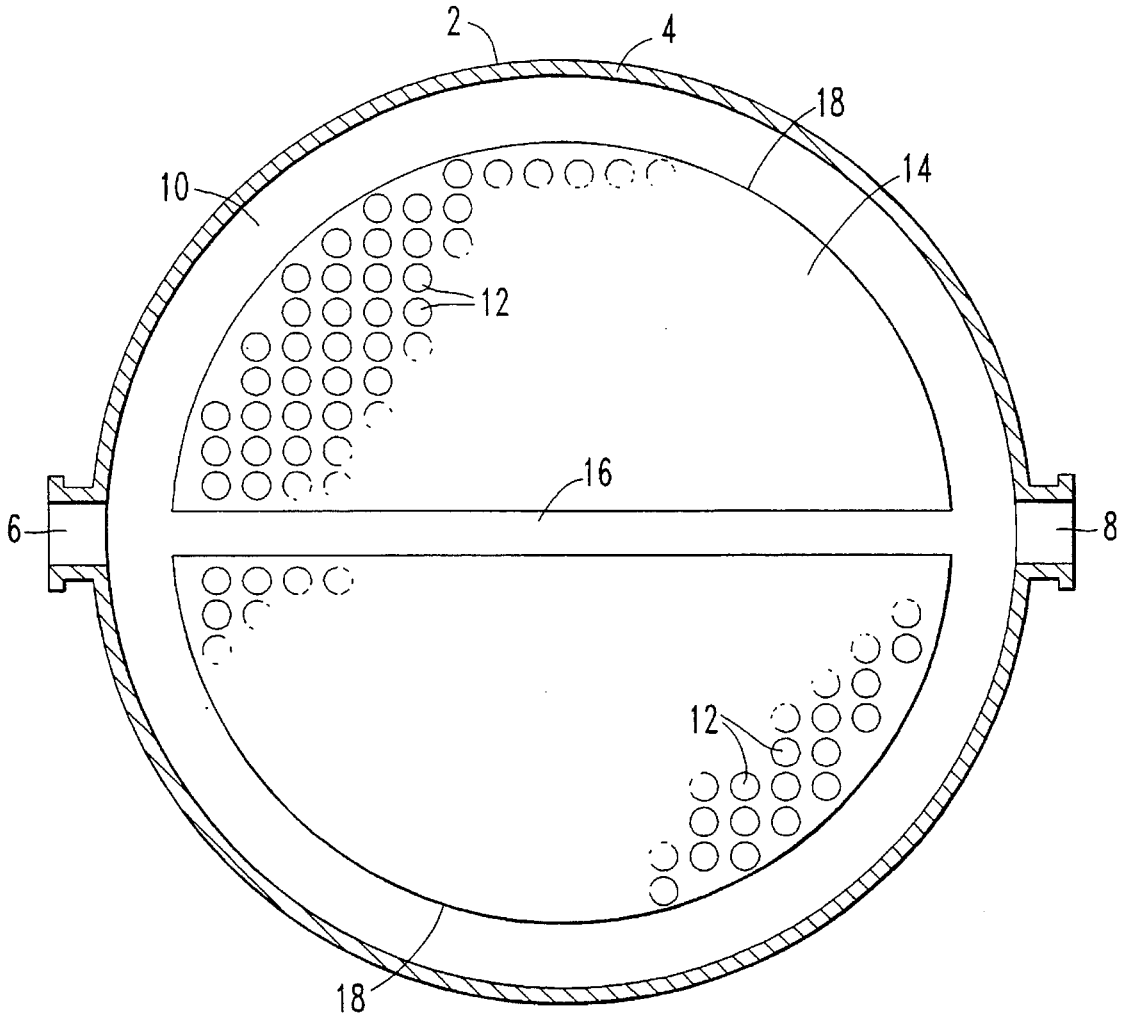
FIG. 1 PRIOR ART
FIG. 1 is a sectioned plan view of a conventional nuclear steam generator having two handhole openings.

Referring to FIG. 1, a sectioned plan view of a conventional nuclear steam generator 2 is illustrated, it being understood that the invention is applicable to a variety of heat exchangers, such as fossil steam generators or reheaters. The steam generator 2 includes an outer cylindrical shell 4 and two openings 6, 8 which are generally referred to as handholes. Immediately inside the shell 4 is an annulus 10.

Figure 2:
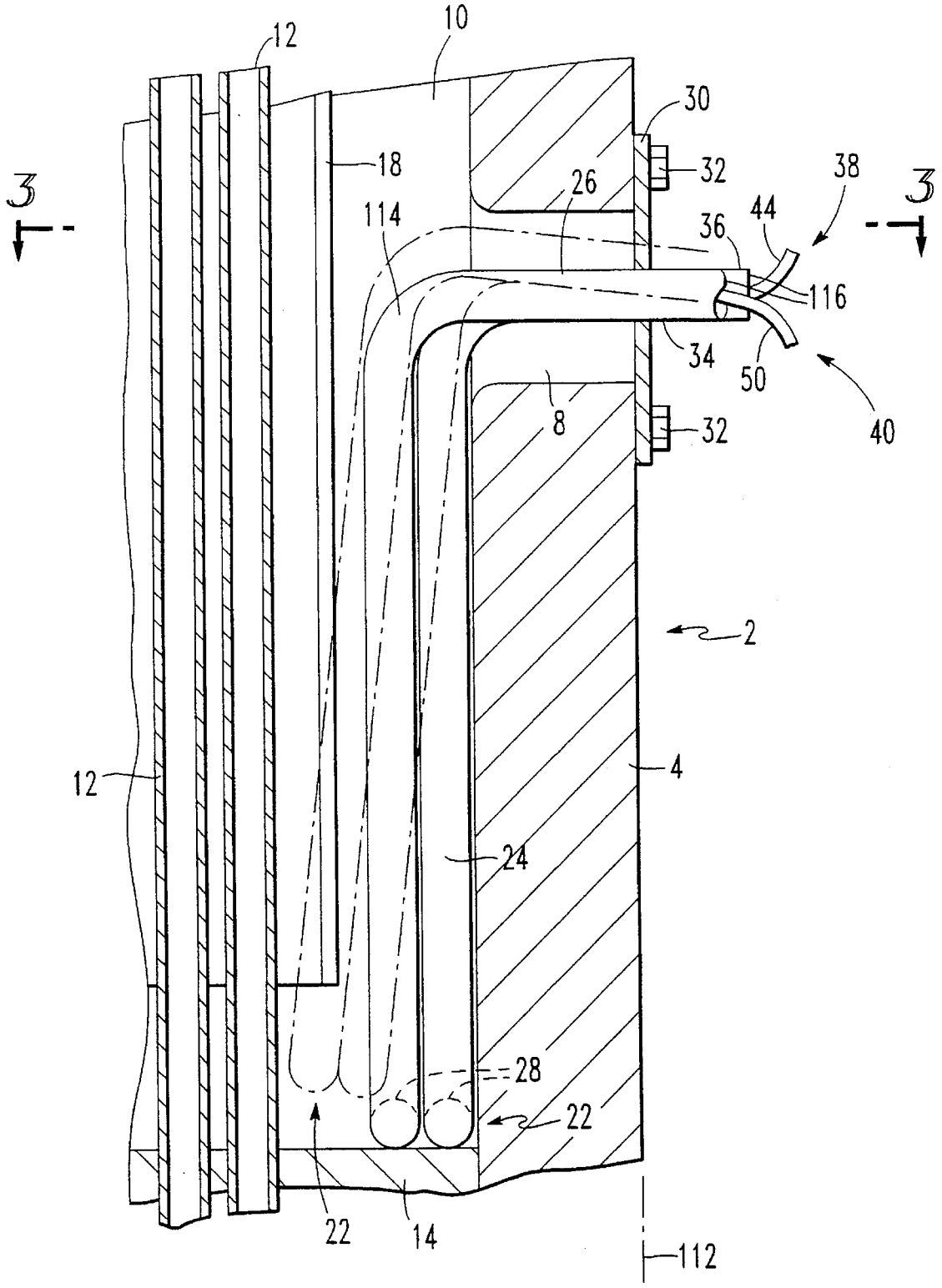
FIG. 2 is a fractional vertical sectional view of a lower portion of the shell of a conventional nuclear steam generator showing dual guide tubes extending through a handhole opening down to the periphery of the tube sheet in accordance with the invention.
Figure 3:
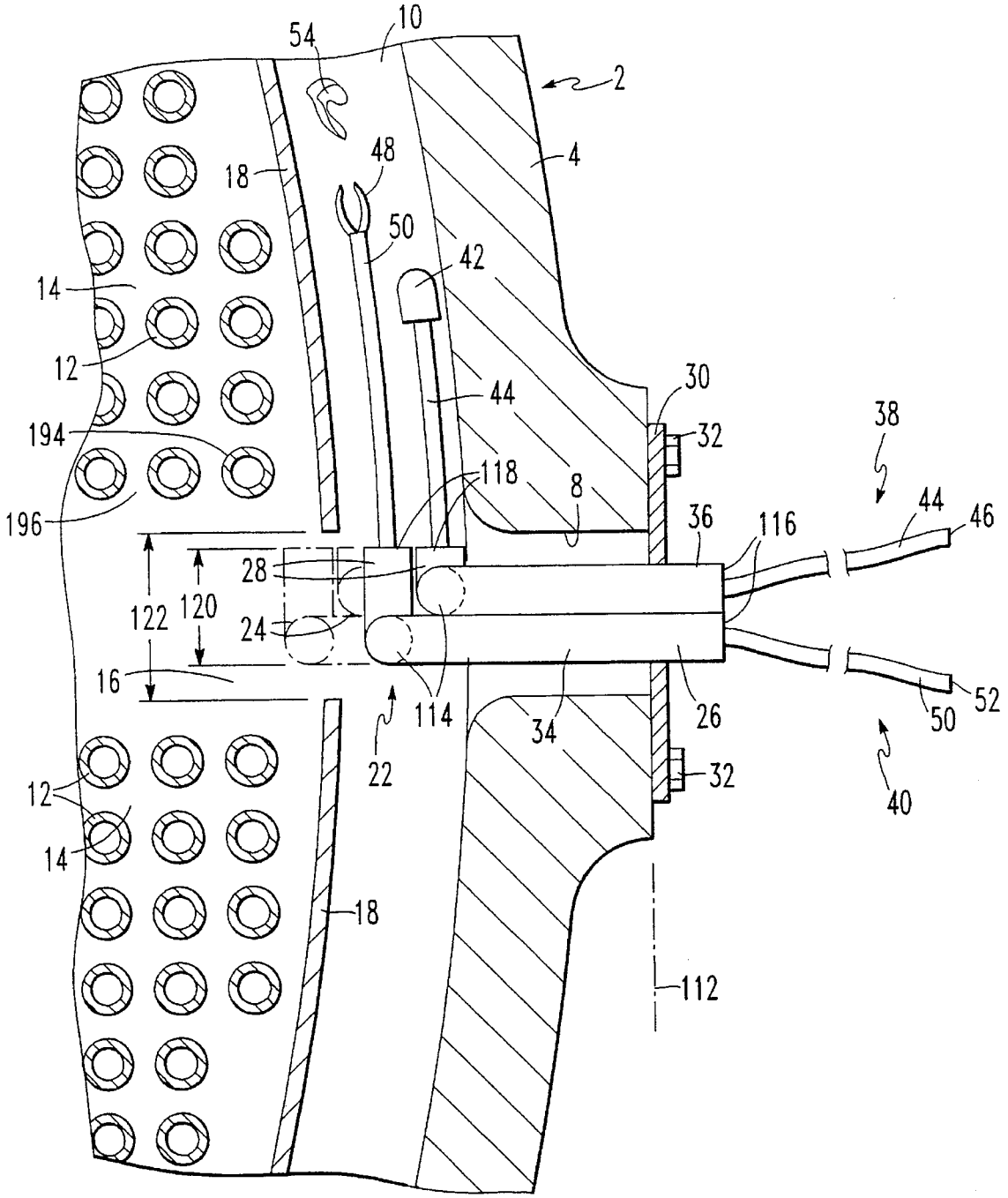
FIG. 3 is a fractional horizontal sectional view, taken along line 3—3 of FIG. 2, showing a top view of the dual guide tubes in accordance with the invention in position at the periphery of the tube sheet.

Referring to FIGS. 1, 2 and 3, the steam generator 2 further includes a plurality of closely spaced vertical tubes 12 supported by and extending upwardly from a tube sheet 14. The vertical tubes 12 are associated by pairs with a U-bend at the top (not shown) so as to straddle two sides of an aisle or tube lane 16, as shown in FIGS. 1 and 3, extending centrally across the shell 4. In the exemplary embodiment, the tubes 12 are surrounded by a wrapper barrel 18 spaced approximately two inches from the interior wall of the shell 4 to form the annulus 10, therewith.

As shown in FIG. 2, the exemplary wrapper barrel 18 and, consequently, the annulus 10, extend downwardly to a point which is approximately thirteen inches above the tube sheet 14. As shown by FIGS. 1 and 3, the tube sheet 14 is separated into two halves by the tube lane 16. As shown by FIG. 1, the handholes 6, 8 open into the tube lane 16.

Continuing to refer to FIGS. 2 and 3, a pair of guide tubes 22 has two straight main segments 24, two upper segments 26 which are bent at a right angle with respect to the main segments 24, and two lower segments 28 which are also bent at a right angle with respect to the main segments 24. Each of the lower segments 28, which rest on and are parallel to the surface of the tube sheet 14, extends in a direction rotated 90° from the direction of the corresponding upper segment 26. In this manner, each lower segment 28 is generally perpendicular to the corresponding upper segment 26. The pair of guide tubes 22 is secured at the upper segments 26 to the shell 4 at the handhole 8 by a guide plate 30 which is fastened to the shell 4 by a plurality of bolts 32.

Still referring to FIGS. 2 and 3, the pair of guide tubes 22 includes two parallel conduits or tubes 34, 36 which may be utilized to guide a search device 38 and a retrieval device 40 into the steam generator 2. As shown in FIG. 3, the exemplary search device 38 includes an inspection probe 42 (e.g., a fiberscope, a video probe, a miniature television camera, etc.) having a light source (not shown), a cable 44 having one or more optical fibers (not shown), and a receiving end 46 for viewing the inside of the steam generator 2 and for maneuvering the probe 42 within the steam generator 2. A non-limiting example of the search device 38 is a model VS231 video probe marketed by Welch Allyn, it being understood that the present invention is applicable to a wide variety of search devices, including such devices suitable for underwater operation.

As also shown in FIG. 3, the exemplary retrieval device 40 includes a gripper 48, a cable 50, and a control end 52 for controlling and maneuvering the gripper 48 within the steam generator 2. A non-limiting example of the retrieval device 40 is marketed by Wolf & Company as model 1.50600.00. The exemplary retrieval device 40 supports a plurality of grippers (e.g., a fork having tines, a pair of viper jaws, a magnet, a suction device providing a vacuum, etc. ), it being understood that the present invention is applicable to a wide variety of retrieval devices, including such devices suitable for underwater operation. The exemplary cable 50 is an articulating guide conduit and includes an internal cable (not shown) which is remotely manually pushed or pulled, in order to open and close the gripper 48, or, alternatively, which is driven by an air cylinder (not shown), in order to extend the remote operation of the retrieval device 40. The gripper 48 is suitable for picking up or otherwise moving a foreign object 54 within the steam generator 2.

As discussed below in greater detail with FIGS. 7A and 7B, the cables 44 and 50 of the search device 38 and the retrieval device 40, respectively, extend through the handhole 8 and are utilized for positioning the respective devices 38 and 40 within the steam generator 2. In this manner, the two parallel tubes 34, 36 may guide search devices 38 and/or retrieval devices 40 from the handholes 6, 8 of FIG. 1, through the annulus 10 and onto the tube sheet 14 of the steam generator 2. Preferably, the receiving end 46 and the control end 52 of the respective cables 44, 50 include a remote 4-way articulating capability which provides greater maneuverability of the respective devices 38, 40 within the steam generator 2.

Figure 4:
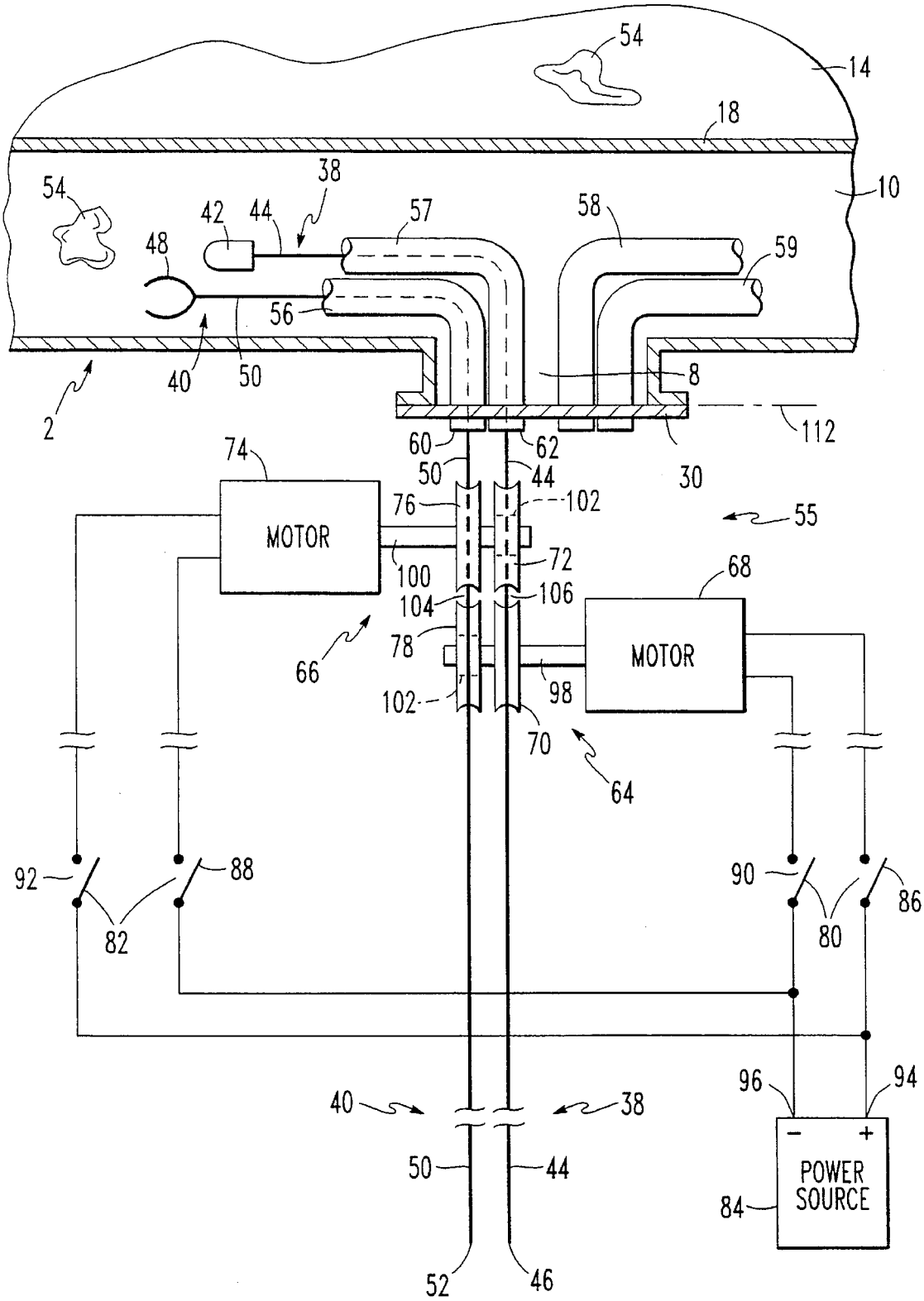
FIG. 4 is a schematic of a steam generator showing four guide tubes in position at the periphery of the tube sheet and, also, showing dual motors and dual pinch rollers for driving cables of search devices and retrieval devices in accordance with the invention.

Referring to FIG. 4, a schematic of the steam generator 2 shows a cable drive apparatus 55 having four guide tubes 56–59 in position at the periphery of the tube sheet 14. The search device 38 is routed through the guide tube 57 and the retrieval device 40 is routed through the guide tube 56, it being understood that any of the guide tubes 56–59 are suitable for guiding any of the devices 38, 40. The probe 42 of the search device 38 and the gripper 48 of the retrieval device 40 are positioned on the surface of the tube sheet 14. The cable 50 of the retrieval device 40 passes through an opening 60 of the guide tube 56 adjacent the guide plate 30 at handhole 8. Similarly, the cable 44 of the search device 38 passes through an opening 62 of the guide tube 57 adjacent the guide plate 30 and beside the opening 60. As described in greater detail below, a drive mechanism 64 drives the cable 44 of the search device 38 and a drive mechanism 66 drives the cable 50 of the retrieval device 40, in order to position the search device 38 and the retrieval device 40, respectively, within the steam generator 2, it being understood that any of the drive mechanisms 64, 66 are suitable for driving any of the cables 44, 50.

The drive mechanism 64 includes an exemplary reversible high torque direct current (DC) electric motor 68 and two exemplary rubber pinch rollers 70, 72 for driving the cable 44 of the search device 38. Similarly, the drive mechanism 66 includes a reversible motor 74 and two pinch rollers 76, 78 for driving the cable 50 of the retrieval device 40. Two remote energizing mechanisms 80, 82, which have a common power source 84, independently energize the drive mechanisms 64, 66, respectively. Alternatively, a separate power source (not shown) for each of the remote energizing mechanisms 80, 82 may be provided. The remote energizing mechanisms 80, 82 include respective forward switches 86, 88 and reverse switches 90, 92. The forward 86, 88 and reverse switches 90, 92 interconnect a positive voltage 94 and a negative voltage 96, respectively, from the power source 84 with the exemplary reversible DC motors 68, 74. In this manner, the reversible motors 68, 74 may be selectively and independently energized by one of the remote energizing mechanisms 80, 82, respectively, in a forward or a reverse direction.

Each of the reversible motors 68, 74 has a drive shaft 98, 100, respectively. Each of the drive shafts 98, 100 is fixedly attached to a respective pinch roller 70, 76, in order to independently drive and rotate the pinch roller 70, 76 in the selected forward or reverse direction. Each of the other pinch rollers 72, 78 includes a bearing 102 (shown in shadow) which enables the pinch rollers 72, 78 to freely rotate about the drive shafts 100, 98 of the reversible motors 74, 68, respectively. In this manner, each of the drive mechanisms 64, 66, the energizing mechanisms 80, 82, the reversible motors 68, 74, and the pairs of pinch rollers 70–72, 76–78 are independent from the other drive mechanisms, energizing mechanisms, motors and pinch rollers.

Furthermore, by remotely utilizing the receiving end 46 of the search device 38, the control end 52 of the retrieval device 40, and the remote energizing mechanisms 80, 82, totally remote search and retrieval of foreign objects 54 within and from the steam generator 2 may be conducted by inspection personnel, for example, from outside of a containment vessel (not shown). Therefore, the exposure to radiation from the handholes 6 (see FIG. 1) and 8 is significantly reduced.

The pairs of pinch rollers 76–78, 70–72 include openings 104, 106 which are adjacent the openings 60, 62 of the guide tubes 56, 57, respectively. As illustrated in FIG. 4 and as described in greater detail below with FIGS. 7A and 7B, the openings 60, 62 for the cables 44, 50 correspond to the left half of the guide plate 30.

Figure 5:
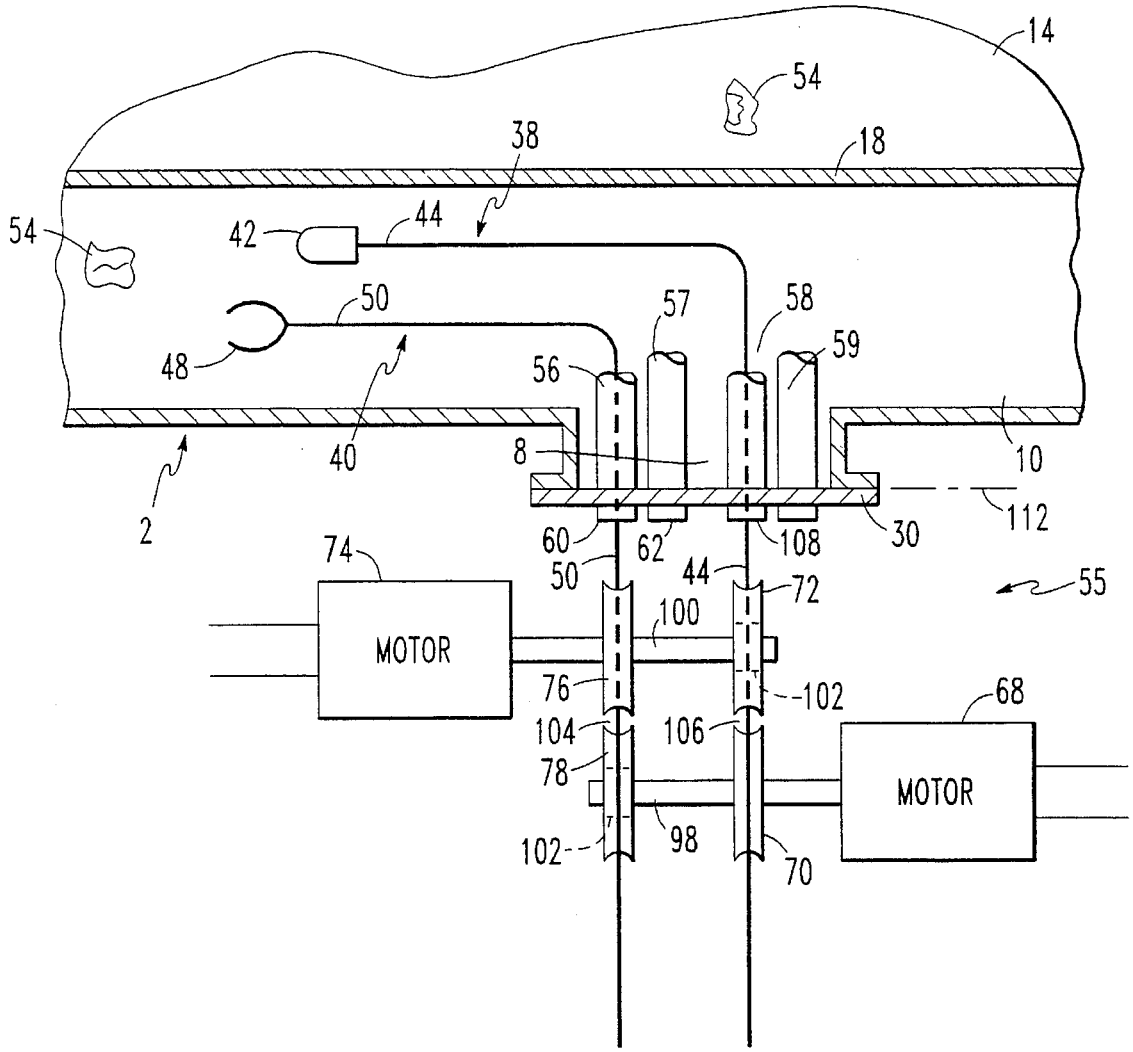
FIG. 5 is a schematic of a steam generator showing four guide tubes in position at the periphery of the tube sheet and, also, showing dual motors and dual pinch rollers for driving cables of search devices and retrieval devices in accordance with an alternative embodiment of the invention.

Alternatively, as shown in FIG. 5, the opening 106 of the pair of pinch rollers 70–72 is adjacent an opening 108 of the guide tube 58 at the right or second half of the guide plate 30. Also, the opening 104 of the pair of pinch rollers 76–78 is adjacent the opening 60 of the guide tube 56 at the left or first half of the guide plate 30. In this manner, the search and retrieval devices 38, 40 may be inserted in the same half of the annulus 10, as shown in FIG. 4, or, alternatively, may be inserted in opposite halves of the annulus 10, as shown in FIG. 5.

Figure 6:
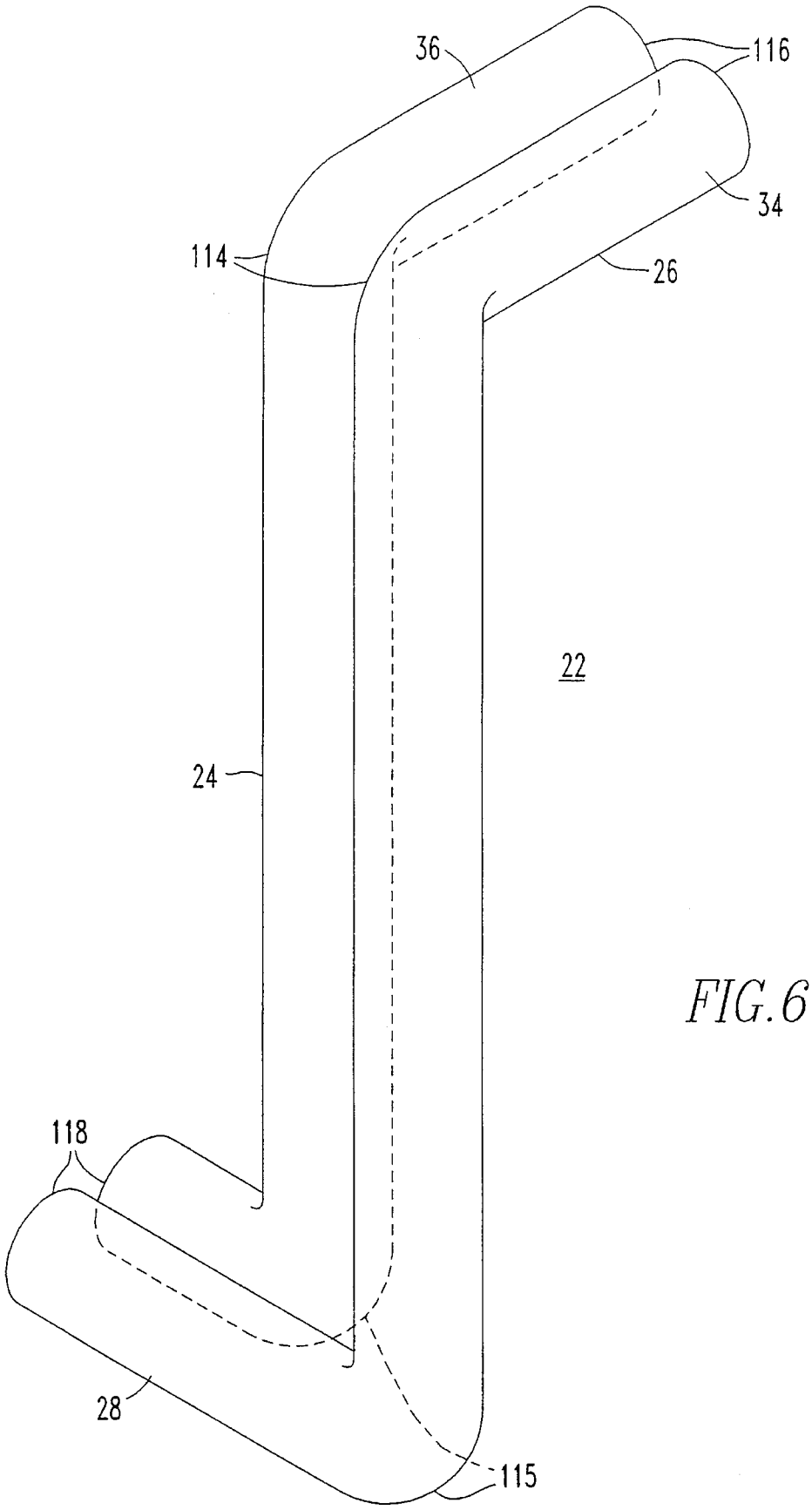
FIG. 6 is an isometric view of dual guide tubes for guiding search devices and retrieval devices between the guide plate of the handhole and the tube sheet in accordance with the invention.

FIG. 6 illustrates an isometric view of the pair of guide tubes 22 of FIGS. 3 and 4. The exemplary stainless steel pair of guide tubes 22 includes a first stainless steel conduit or tube 34 which is attached beside a second stainless steel conduit or tube 36. Other equivalent pairs of guide tubes 22, however, are possible, such as a segmented pair of guide tubes, a pair of guide tubes having a rectangular shape, a single conduit having two or more tubes 34, 36 routed therethrough, or a single conduit which is divided into two internal sections for the search device 38 and the retrieval device 40 of FIGS. 2–5. Furthermore, other suitable materials, such as nylon, are also possible.

Referring again to FIGS. 2 and 3, the pair of guide tubes 22 extends between the guide plate 30 of the handhole 8 and the tube sheet 14 of the steam generator 2. The tube 36, for example, may be utilized to guide the cable 44 of the search device 38. Similarly, the tube 34, for example, may be utilized for guiding the cable 50 of the retrieval device 40. Those skilled in the art will appreciate that other combinations of tubes 34, 36, search devices 38 and retrieval devices 40 are possible. For example, multiple search devices 38 may be utilized in both halves of the annulus 10 or tube sheet 14, three or more parallel tubes 34, 36 with three or more corresponding drive mechanisms 64, 66 of FIG. 4 may be utilized in either half of the annulus 10 or tube sheet 14, two retrieval devices 40 may be utilized with one search device 38, or a search device 38 may be used from one of the handholes 6, 8 of FIG. 1 and a retrieval device 40 may be used from the other of the handholes 6, 8. Furthermore, other varieties of single or multiple tubes 34, 36 may be utilized for the tube lane 16 and other internal regions of the steam generator 2.

The exterior of the handhole 8 defines a plane 112 which is parallel with the plane of the guide plate 30. As best shown in FIG. 6, the pair of guide tubes 22 and the individual tubes 34, 36 thereof each have a double-dog-leg shape and a single-piece construction. Two bends 114 interconnect the main segments 24 with the upper segments 26. Similarly, two bends 115 interconnect the main segments 24 with the lower segments 28. The upper segments 26 terminate at two ends 116 which pass through the guide plate 30 and are secured thereto. In this manner, as discussed in greater detail with FIGS. 7A and 7B, the drive mechanisms 64, 66 may pivot, without interference from the pair of guide tubes 22, between both halves of the guide plate 30. The lower segments 28 terminate at two ends 118 which rest on the tube sheet 14.

As best shown by FIG. 3, the length of the upper segments 26, which pass through the handhole 8 and the guide plate 30, is longer than the length of the lower segments 28, which rest on the tube sheet 14 within a region defined by the annulus 10. Whenever the pair of guide tubes 22 is initially manually inserted into the steam generator 2 in an oblique position (as shown in shadow in FIGS. 2 and 3), the lower segments 28 are inserted through the handhole 8, through the annulus 10, and into the tube lane 16. This oblique position is possible because the length 120 of the lower segments 28 is smaller than the width 122 of the tube lane 16. Then, using the ends 116 of the upper segments 26, the pair of guide tubes 22 is straightened to the generally vertical position of FIG. 2. Then, the guide plate 30 is installed, in order to secure the pair of guide tubes 22 in the vertical position. In this manner, the pair of guide tubes 22 is manually insertable into the steam generator 2 without manually breaking the plane 112 of the handhole 8. Accordingly, inspection personnel are exposed to significantly less radiation from the nuclear steam generator 2.

Figure 7A:
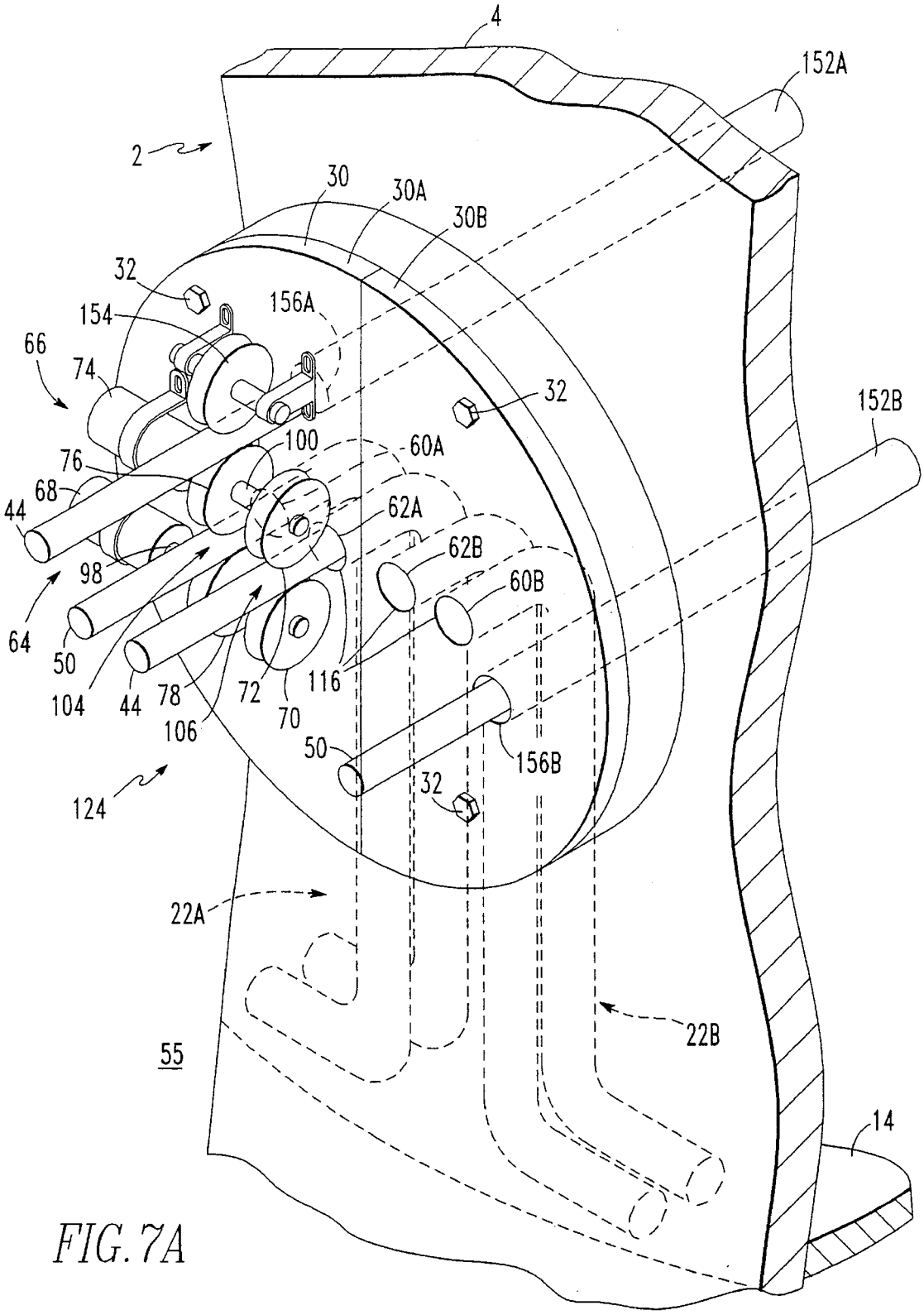
FIG. 7A is an isometric view, with some parts cut-away, of dual motors, dual pinch rollers and supports for driving cables of search devices and retrieval devices in accordance with the invention.

As illustrated by FIG. 7A, an exemplary guide mechanism 124 includes a pair of guide tubes 22A between the handhole 8 and the left half of the tube sheet 14. The guide mechanism 124 also includes a pair of guide tubes 22B, which is a mirror image of the pair of guide tubes 22A. The pair of guide tubes 22B extends between the handhole 8 and the right half of the tube sheet 14. The guide mechanism 124 further includes the guide plate 30 which is mounted to the handhole 8 by a plurality of the bolts 32. The pair of guide tubes 22A terminates on a left half 30A of the guide plate 30 and the pair of guide tubes 22B terminates on a right half 30B of the guide plate 30. The ends 116 of each of the pairs of guide tubes 22A, 22B pass through the guide plate 30 and are flush mounted thereto by threads (not shown). In this manner, the drive mechanisms 64, 66 pivot, without interference from the guide tubes 22A, 22B, between both halves 30A, 30B of the guide plate 30.

Two openings 60A, 62A of the pair of guide tubes 22A are adjacent the corresponding openings 104, 106 of the pinch rollers 76–78, 70–72, respectively. As discussed in greater detail below with FIG. 7B, two openings 60B, 62B of the pair of guide tubes 22B are located, in a mirror image position with respect to the left half 30A, at the right half 30B of the guide plate 30. As also discussed below with FIG. 7B, the two openings 60B, 62B of the pair of guide tubes 22B correspond to the openings 104, 106 of the pinch rollers 76–78, 70–72, respectively.

Figure 7B:
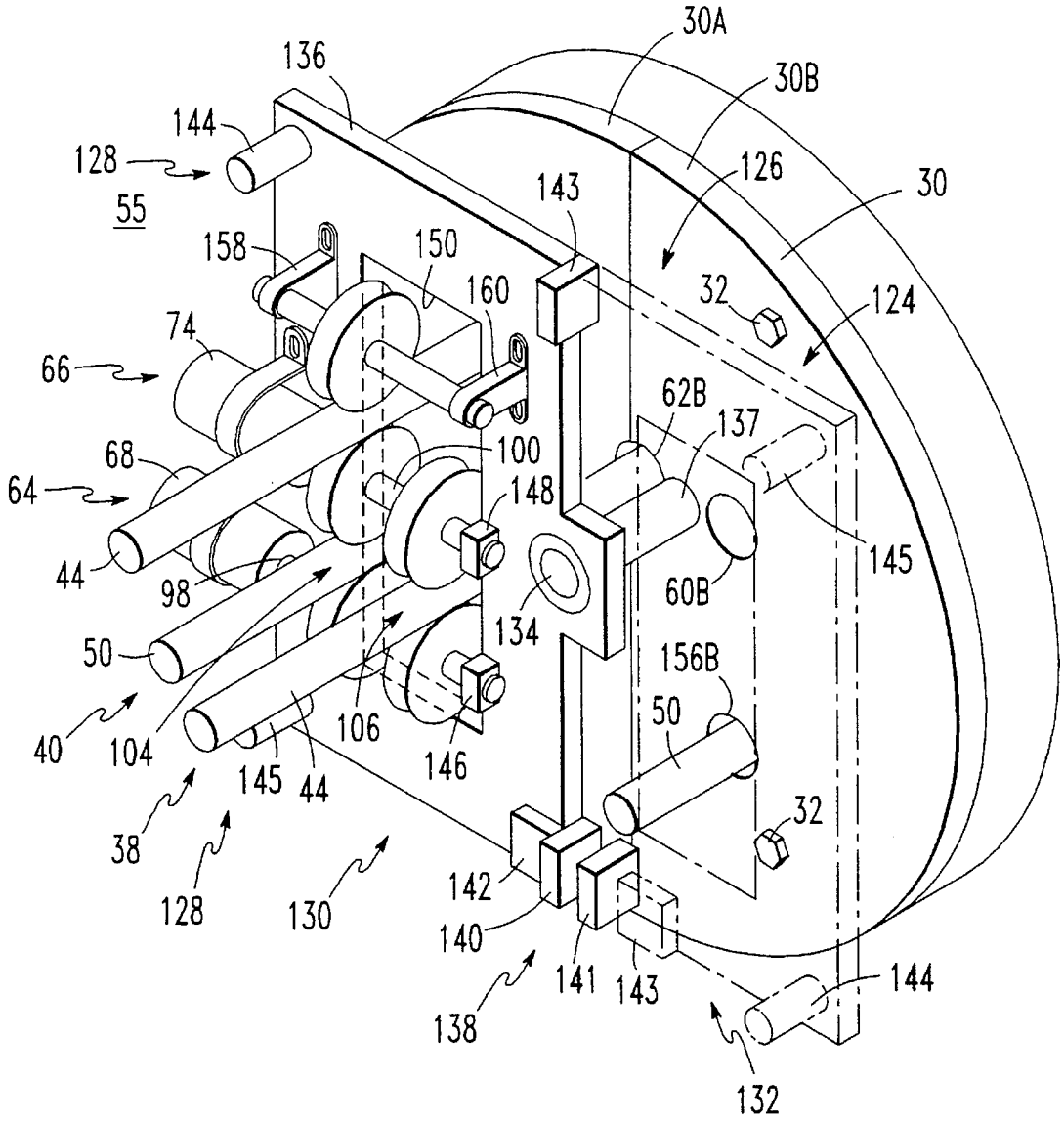
FIG. 7B is an isometric view of a housing for holding the dual motors, dual pinch rollers and supports of FIG. 7A, and a pivot for rotating the housing between opposite halves of the guide plate in accordance with the invention.

Referring to FIG. 7B, the exemplary cable drive mechanism 55 further includes a selection mechanism 126 for selecting either half of the tube sheet 14 for positioning the search device 38 and the retrieval device 40 of FIGS. 2 and 3 thereon. As discussed in greater detail below, the selection mechanism 126 cooperates with the drive mechanisms 64, 66 which drive the cables 44, 50 of the search device 38 and the retrieval device 40, respectively, in order to position the search device 38 and the retrieval device 40 on a selected half of the tube sheet 14. The selection mechanism 126 includes a moving mechanism 128 for moving the drive mechanisms 64, 66 between a first position 130 which corresponds to the left half 30A of the guide plate 30 and a second position 132 (shown in shadow) which corresponds to the right half 30B of the guide plate 30.

Attached to the center of the guide plate 30 is a rod 134. The rod 134 extends in a direction perpendicular to the plane of the guide plate 30 (and the plane 112 of the handhole 8 of FIG. 3). A holder 136, which is generally parallel to the plane 112 of the handhole 8, includes a cylindrical pivot mechanism 137 which has a plurality of internal bearings (not shown). The cylindrical pivot mechanism 137 is attached at an end to the holder 136 and is pivotally attached to the rod 134. The pivot mechanism 137, thus, allows the holder 136 to move or rotate about the rod 134. Also attached to the holder 136 are the drive mechanisms 64, 66. Whenever the holder 136 is rotated about the rod 134, the drive mechanisms 64, 66 are rotated between the left half 30A and the right half 30B of the guide plate 30.

A latching stop 138 having two latches 140, 141, such as the exemplary magnetic latches, projects from the lower part of the guide plate 30 between the halves 30A, 30B. Alternatively, any type of latch (e.g., mechanical, pneumatic, etc.) may be provided. Two mating latches 142, 143 for the two latches 140, 141, respectively, are attached on two corners of the holder 136. The latches 140, 142 latch the holder 136 and, hence, hold the pivot mechanism 137 in a position corresponding to the left half 30A of the guide plate 30. Similarly, the latches 141, 143 also latch the holder 136 and, thus, hold the pivot mechanism 137 in a position corresponding to the right half 30B of the guide plate 30.

The exemplary moving mechanism 128 includes two handles 144, 145 which are attached on two corners of the holder 136 opposite from the latches 142, 143, respectively. The handles 144, 145 are used to manually unlatch the latches 140, 142, rotate the holder 136 about the rod 134, and latch the latches 141, 143, it being understood that other equivalent moving mechanisms 128 may be provided which integrate a handle and a latch in a spring loaded pin (not shown) for unlatching, moving and latching the holder 136, or which automatically unlatch, rotate and latch the holder 136 in response to a remote position selection signal (not shown).

The holder 136 also includes two supports 146, 148 which rotatably support the shafts 98, 100 of the motors 68, 74, respectively. The holder 136 further includes an opening 150 for routing the cables 44, 50 of the search device 38 and the retrieval device 40 therethrough. These cables 44, 50 first pass through the openings 106, 104 of the two pairs of pinch rollers 70–72, 76–78, respectively, and, then, the opening 150, before entering the openings 62A, 60A of FIG. 7A, respectively, of the pair of guide tubes 22A.

The selection mechanism 126 selectively locates the drive mechanisms 64, 66 in one of two positions 130, 132. The position 130 corresponds to the pair of guide tubes 22A which terminate on the left half 30A of the guide plate 30. The position 132 (shown in shadow) corresponds to the pair of guide tubes 22B which terminate on the right half 30B of the guide plate 30. Therefore, the search device 38 and the retrieval device 40 may be inserted into the left half of the tube sheet 14 whenever the holder 136 and the attached drive mechanisms 64, 66 are positioned at the left half 30A of the guide plate 30. Similarly, these devices 38, 40 may be inserted into the right half of the tube sheet 14 whenever the holder 136 and, hence, the attached drive mechanisms 64, 66 are rotated about the rod 134 to the right half 30B of the guide plate 30.

Referring to FIGS. 2, 3, 7A and 7B, those skilled in the art will appreciate that the probe 42 of the search device 38 may be utilized to visually position the probe 42 and the gripper 48 of the retrieval device 40 outside of the plane 112 of the handhole 8, outside of the guide plate 30, and outside of one of the pairs of guide tubes 22A, 22B while the cables 44, 50 are held by the pinch rollers 70–72, 76–78, respectively. Then, the selection mechanism 126 may be used to selectively locate the drive mechanisms 64, 66 between the left half 30A and the right half 30B of the guide plate 30. Finally, the drive mechanisms 64, 66 may be independently energized, as discussed above with FIG. 4, in order to power the reversible motors 68, 74 and independently drive the respective pinch rollers 70, 76.

The openings 104, 106 of the pinch rollers 76–78, 70–72, respectively, may be selectively positioned adjacent the corresponding openings 60A–62A, 60B–62B of the pairs of guide tubes 22A, 22B, respectively. The pinch rollers 70, 76 are driven by the drive shafts 98, 100 of the motors 68, 74, respectively. The other pinch rollers 72, 78 freely rotate about the drive shafts 100, 98, respectively. Each pair of pinch rollers 70–72, 76–78 independently engages at the openings 106, 104 the cables 44, 50 of the search and retrieval devices 38, 40, respectively. For operation in the first position 130 at the left half 30A of the guide plate 30, each pair of the pinch rollers 70–72, 76–78 independently drives one of the cables 44, 50 into or from the openings 62A, 60A, respectively. Those skilled in the art will appreciate that similar operation (i.e., each pair of the pinch rollers 70–72, 76–78 independently drives one of the cables 44, 50 into or from the openings 62B, 60B, respectively) is possible from the right half 30B of the guide plate 30 whenever the holder 136 is unlatched and rotated from the first position 130 and is latched at the second position 132.

Furthermore, other guide tubes 152A, 152B may be utilized for the robe lane 16 and other internal regions of the steam generator 2 of FIG. 3. For example, the pinch rollers 76, 154 independently drive one of the cables 44, 50 into or from the opening 156A whenever the holder 136 is positioned in the first position 130. Similarly, the pinch rollers 76, 154 independently drive one of the cables 44, 50 into or from the opening 156B whenever the holder 136 is positioned in the second position 132. As discussed above, the pinch roller 76 is driven by the shaft 100 of the motor 74. The pinch roller 154 freely rotates about the supports 158, 160.

Figure 7C:
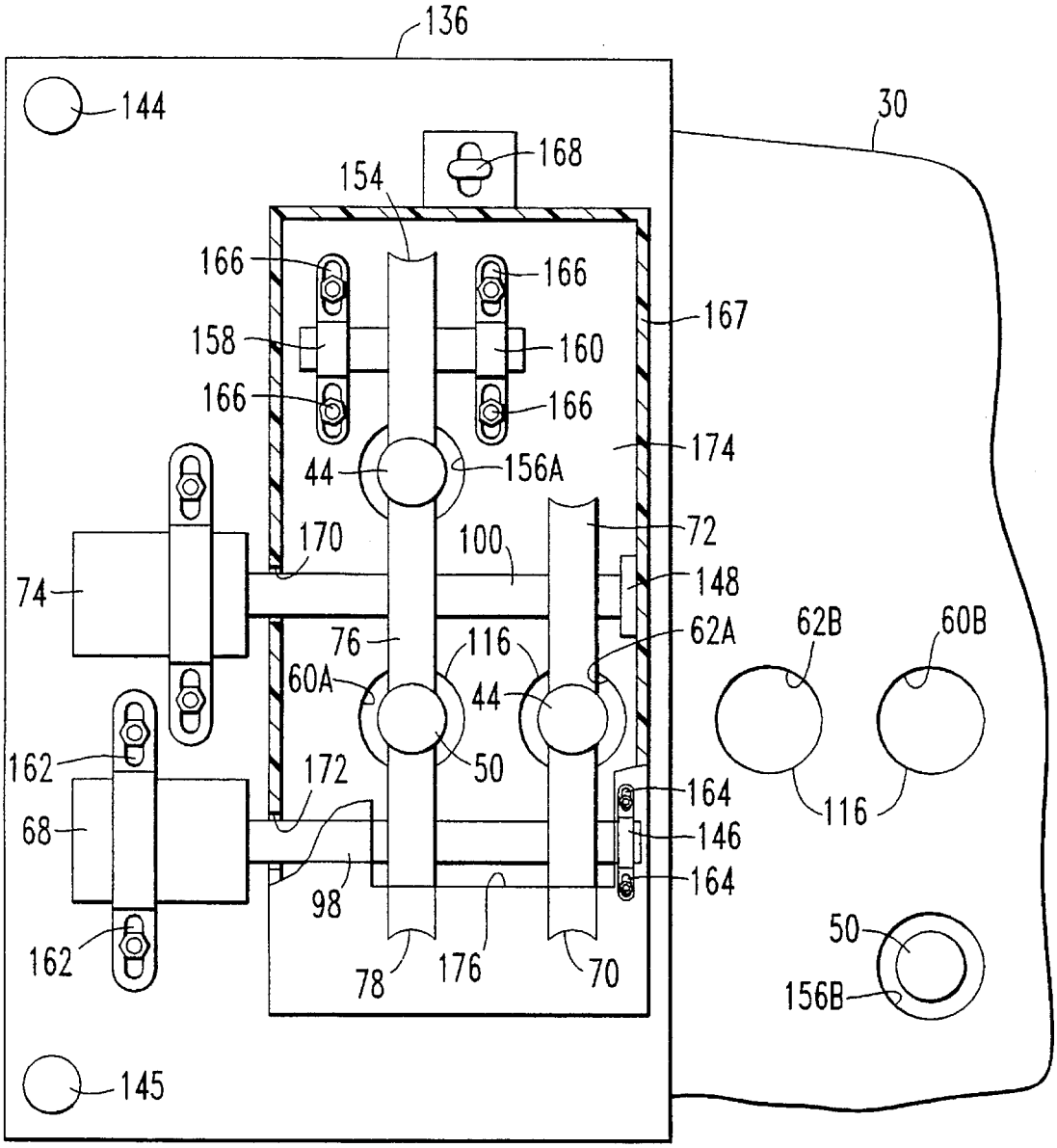
FIG. 7C is a cut-away plan view of an enclosure for use with the dual pinch rollers and supports of FIGS. 7A and 7B in accordance with the invention.

As shown in FIG. 7C, in order to accommodate cables 44, 50 of various diameters, the motor 68 and support 146 include slotted mounts 162, 164, respectively, which provide an adjustable tension between the pinch rollers 70, 72 and 76, 78. Similarly, the supports 158, 160 for the pinch roller 154 include slotted mounts 166 which provide an adjustable tension between the pinch rollers 76, 154. Those skilled in the art will appreciate that other equivalent mechanisms for adjusting the tension between the pinch rollers may be provided, such as a spring adjustment (not shown) or a remotely activated pneumatic pressure adjustment (not shown). Those skilled in the art will further appreciate that additional motors having rubber wheels (not shown) may be provided for rotating each of the cables 44, 50. In this manner, the cables 44, 50 and the respective inspection probe 42 and gripper 48 may be appropriately positioned (e.g., in order to upright the video image) within the steam generator 2 of FIG. 3.

Still referring to FIG. 7C, the pinch rollers 70, 72, 76, 78, 154 and the supports 146, 148, 158, 160 are covered by a plexiglass enclosure 167. The exemplary enclosure 167 has a quarter-turn fastener 168 for attaching the enclosure 167 to the holder 136. The enclosure 167 also has two mounting slots 170, 172 for the respective motor shafts 100, 98. The enclosure 167 further has an open face 174 at the rear of the enclosure 167 and a hole 176 at the front of the enclosure 167 for routing the cables 44, 50 therethrough.

Figure 8:
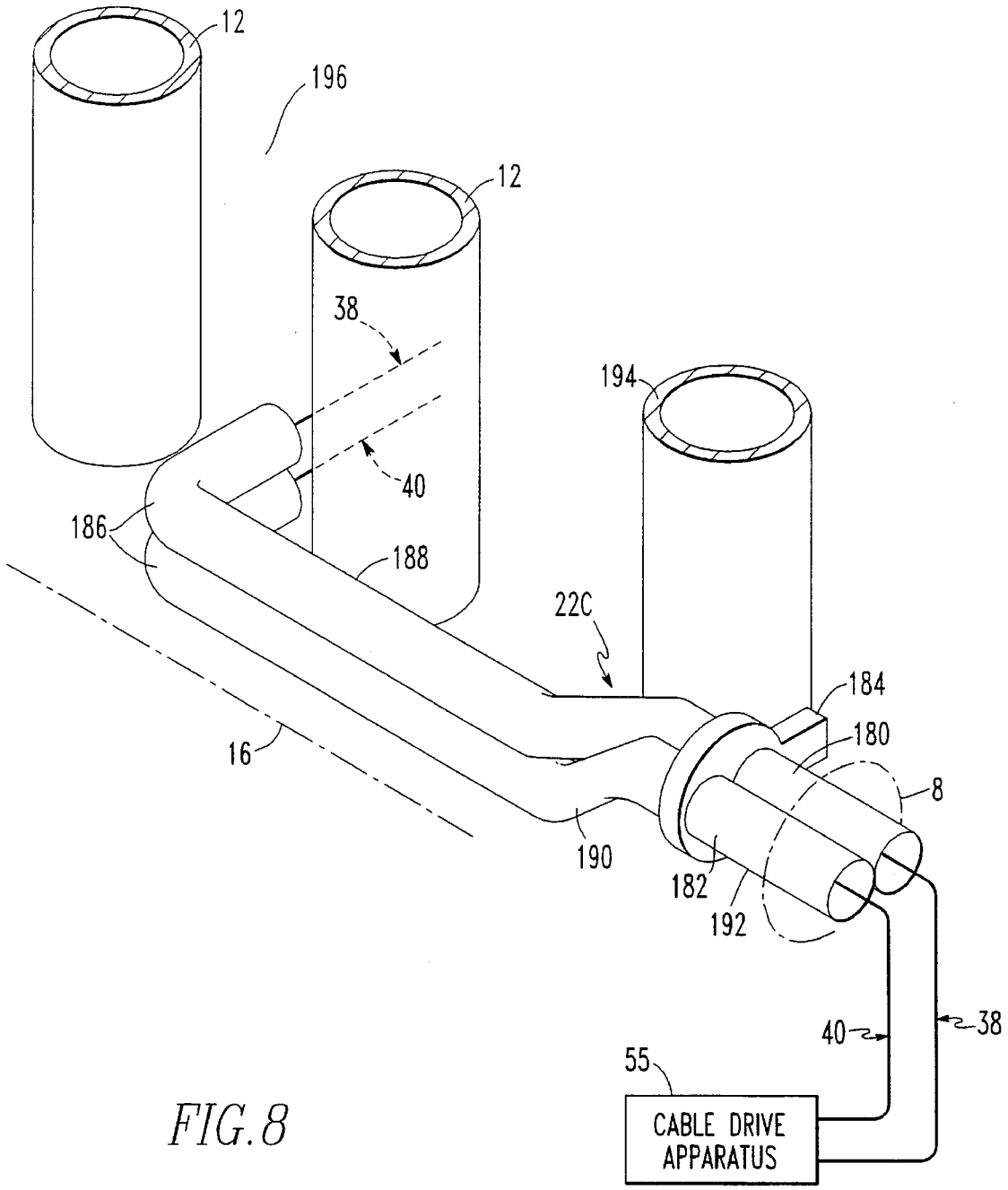
FIG. 8 is an isometric view of dual guide tubes for guiding search devices and retrieval devices between the guide plate of the handhole and the tube lane in accordance with an alternative embodiment of the invention.

FIG. 8 illustrates an isometric view of an alternative pair of guide tubes 22C. The exemplary stainless steel pair of guide tubes 22C includes a first stainless steel conduit or tube 180 which is attached beside a second stainless steel conduit or tube 182. The principal differences between the pair of guide tubes 22C and the pairs of guide tubes 22, 22A, 22B of FIGS. 2–3, 6 and 7A–7B are the shape of the tubes 180, 182, which are designed for use in the tube lane 16 of FIGS. 1 and 3, and a first tube indicator 184, which is discussed in detail below. Otherwise, those skilled in the art will appreciate that the pair of guide tubes 22C may be used in place of the pair of guide tubes 22A or 22B of FIGS. 7A–7B.

Other equivalent pairs of guide tubes 22C, however, are possible, such as a segmented pair of guide tubes, a pair of guide tubes having a rectangular shape, a single conduit having two or more tubes 180, 182 routed therethrough, or a single conduit which is divided into two internal sections for the search device 38 and the retrieval device 40 of FIGS. 2–5 and 7A–7B. Furthermore, other suitable materials, such as nylon, are also possible.

The pair of guide tubes 22C includes an L-bend 186 for accessing between adjacent columns of the tubes 12 of FIG. 3 in a direction perpendicular to the tube lane 16 of FIG. 3. The pair of guide tubes 22C also includes a section 188, in which the tube 182 rests on the tube lane 16 (as shown in shadow in FIG. 8); a section 190, which is generally at an angle of about 45 degrees with respect to the section 188; and a section 192, which is generally parallel to the tube lane 16 for exiting one of the handholes 6, 8 of FIG. 1. Alternatively, the section 190, may be at any suitable angle (e.g., between 0 degrees and 90 degrees) with respect to the section 188. The section 190, therefore, accommodates for the different elevations of the tube lane 16 and the handholes 6, 8. In this manner, the pair of guide tubes 22C is suitable for manual retrieval of objects from adjacent the tube lane 16. Furthermore, the pair of guide tubes 22C may be used with the cable drive apparatus 55 of FIG. 7A–7B for totally remote search and retrieval of foreign objects from adjacent the tube lane 16 of the steam generator 2.

The first tube indicator 184 is slidably attached to the section 192. By knowing the distance between the first tube 194 of FIG. 3 and the desired column 196 of FIG. 3 for a search and retrieval operation, the pair of guide tubes 22C may be quickly positioned by an operator and, hence, exposure to radiation from the handholes 6, 8 of FIG. 1 is significantly reduced.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An apparatus for use with a search device and a retrieval device in a heat exchanger having an annular region and a tube sheet, each of said search device and said retrieval device having a cable for positioning a corresponding one of said search device and said retrieval device within said heat exchanger, said apparatus comprising:

guide means for guiding said search device and said retrieval device through the annular region and onto the tube sheet of said heat exchanger;

first drive means for driving the cable of said search device, in order to position said search device within said heat exchanger; and second drive means for independently driving the cable of said retrieval device, in order to independently position said search device and said retrieval device within said heat exchanger.

2. The apparatus as recited in claim 1, wherein said heat exchanger has a handhole which defines a plane; wherein said guide means includes at least two guide tubes between the handhole and the tube sheet of said heat exchanger, one of the guide tubes for guiding the cable of said search device, another of the guide tubes for guiding the cable of said retrieval device; and wherein each of the at least two guide tubes is manually insertable into said heat exchanger without manually breaking the plane of the handhole.

3. The apparatus as recited in claim 1, wherein said guide means includes at least two guide tubes between the handhole and the tube lane of said heat exchanger, one of the guide tubes for guiding the cable of said search device, another of the guide tubes for guiding the cable of said retrieval device; and wherein each of the guide tubes includes an L-bend, a first section connected to the L-bend for resting on the tube lane, a second section which is oblique with respect to the first section, and a third section which is generally parallel to the first section for exiting the handhole.

4. The apparatus as recited in claim 3 wherein the tube lane has a first tube location and wherein the third section includes locating means for locating the first tube location.

5. The apparatus as recited in claim 1, wherein said heat exchanger has a handhole, wherein the tube sheet is separated into a first half and a second half by a tube lane, and wherein said guide means includes selection means for selecting either the first half or the second half of the tube sheet for positioning said search device and said retrieval device thereon.

6. The apparatus as recited in claim 5, wherein said guide means further includes at least two guide tubes between the handhole and the first half of the tube sheet, and also includes at least two guide tubes between the handhole and the second half of the tube sheet, the selection means cooperating with said first drive means and said second drive means which drive the cables of said search device and said retrieval device, in order to position said search device and said retrieval device on a selected half of the tube sheet.

7. The apparatus as recited in claim 6, wherein said guide means further includes a guide plate which is mounted to the handhole; wherein the at least two guide tubes between the handhole and the first half of the tube sheet terminate on a first half of the guide plate, and the at least two guide tubes between the handhole and the second half of the tube sheet terminate on a second half of the guide plate; and wherein the selection means includes moving means for moving said first drive means and said second drive means between a first position which corresponds to the first half of the guide plate and a second position which corresponds to the second half of the guide plate.

8. The apparatus as recited in claim 7, wherein the guide plate includes a perpendicular rod which is attached between the first half and the second half of the guide plate; and wherein the moving means includes handle means for rotating said first drive means and said second drive means between the first half and the second half of the guide plate.

9. The apparatus as recited in claim 8, wherein the moving means includes a pivot means for pivoting a holding means about the perpendicular rod, the pivot means being fixedly attached to the holding means, the holding means for holding said first drive means and said second drive means thereto.

10. The apparatus as recited in claim 9, wherein the moving means includes first latch means for latching the holding means in the first position and second latch means for latching the holding means in the second position.

11. The apparatus as recited in claim 1, wherein said first drive means includes first pinch roller means for driving the cable of said search device, and wherein said second drive means includes second pinch roller means for driving the cable of said retrieval device.

12. The apparatus as recited in claim 11, wherein each of said first drive means and said second drive means includes remote energizing means for independently energizing a corresponding one of said first drive means and said second drive means, wherein said first drive means includes first reversible motor means for independently driving the first pinch roller means, and wherein said second drive means includes second reversible motor means for independently driving the second pinch roller means, each of the first and second reversible motor means being independently energized by a corresponding one of the remote energizing means.

13. The apparatus as recited in claim 12, wherein each of the first and second reversible motor means has a drive shaft, and wherein each of the first pinch roller means and the second pinch roller means includes two pinch rollers, a first pinch roller being driven by the drive shaft of a corresponding one of the first and second reversible motor means, a second pinch roller being freely rotatable about the drive shaft of another of the first and second reversible motor means.

14. The apparatus as recited in claim 12, wherein said heat exchanger includes a handhole, wherein said guide means further includes a guide plate which is mounted to the handhole, and wherein the first pinch roller means is located at a position which corresponds to a second half of the guide plate and the second pinch roller means is located at another position which corresponds to a first half of the guide plate.

15. The apparatus as recited in claim 12, wherein said heat exchanger includes a handhole, wherein said guide means further includes a guide plate which is mounted to the handhole, and wherein the first pinch roller means and the second pinch roller means are both located at a position which corresponds to a half of the guide plate.

16. An apparatus for use with a plurality of search devices and retrieval devices in a heat exchanger, each of said plurality of search devices and retrieval devices having a cable for positioning a corresponding one of said plurality of search devices and retrieval devices within said heat exchanger, said apparatus comprising:

plural guide means, each of said plural guide means for independently guiding a corresponding one of said plurality of search devices and retrieval devices into said heat exchanger; and plural drive means, each of said plural drive means for independently driving a corresponding one of the cables of said plurality of search devices and retrieval devices, in order to independently position the corresponding one of said plurality of search devices and retrieval devices within said heat exchanger.

* * * * *